US005889394A

United States Patent [19]

Czarnocki

[11] Patent Number: 5,889,394

[45] Date of Patent: Mar. 30, 1999

[54] TEMPERATURE INDEPENDENT CURRENT REFERENCE

[75] Inventor: Walter Czarnocki, Hoffman Estates, Ill.

[73] Assignee: Motorola Inc., Schaumburg, Ill.

[21] Appl. No.: 865,845

[22] Filed: Jun. 2, 1997

[51] Int. Cl.[6] ..... G05F 3/16

[52] U.S. Cl. ..... 323/313

[58] Field of Search ..... 323/312, 313, 323/315, 316, 907; 327/530, 538–541

[56] References Cited

U.S. PATENT DOCUMENTS

| | | | |
|---|---|---|---|
| 4,250,445 | 2/1981 | Brokaw | 323/313 |
| 4,335,346 | 6/1982 | Streit | 323/313 |
| 5,029,295 | 7/1991 | Bennett et al. | 323/313 |
| 5,291,122 | 3/1994 | Audy | 323/313 |
| 5,307,007 | 4/1994 | Wu et al. . | |
| 5,315,230 | 5/1994 | Cordoba et al. | 323/313 |
| 5,557,194 | 9/1996 | Kato | 323/315 |
| 5,666,046 | 9/1997 | Mietus | 323/315 |

*Primary Examiner*—Matthew Nguyen
*Attorney, Agent, or Firm*—Nicholas C. Hopman

[57] ABSTRACT

A current reference (10) includes first and second connected resistors (R1 and R2), a voltage source (12) independent of a supply voltage (Vdd). The voltage source is applied to the first and second resistors (R1 and R2) and has a positive temperature coefficient (TC). The first resistor (R1) has a TC less than the voltage source (12) TC and the second resistor (R2) has a TC greater than the voltage source (12) TC. A resistance value of each of the first and second resistors (R1 and R2) is set such that a combined TC of the first and second resistors (R1 and R2) is essentially equal to the voltage source (12) TC such that the current reference (10) produces a current essentially independent of a temperature of the current reference (10) and the supply voltage (Vdd).

11 Claims, 1 Drawing Sheet

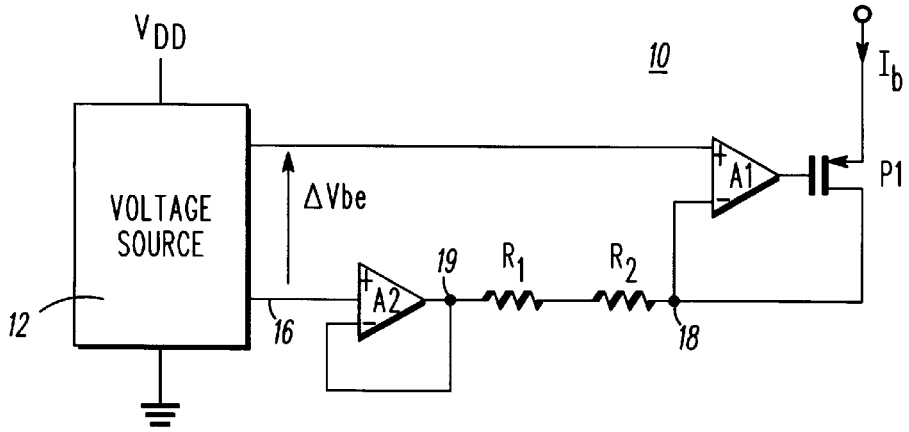
FIG.1
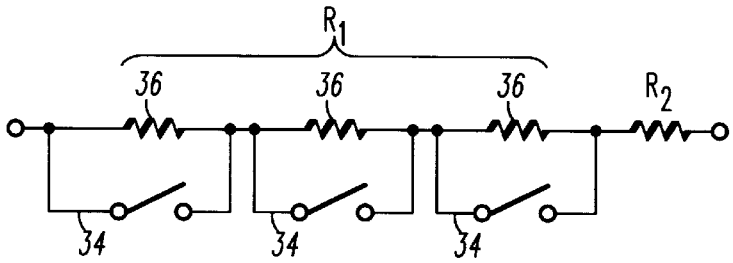
FIG.3
FIG.2
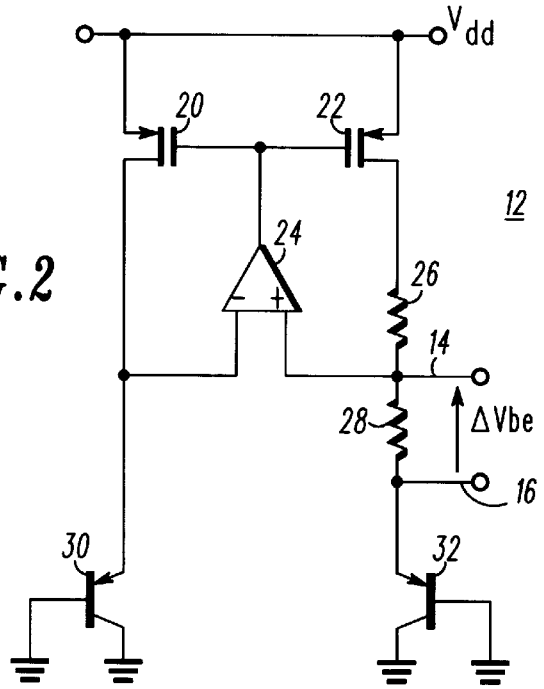

TEMPERATURE INDEPENDENT CURRENT REFERENCE

FIELD OF THE INVENTION

This invention is generally directed to precision current references. More specifically, the present invention is directed to precision current references embodied within an integrated circuit (IC).

BACKGROUND OF THE INVENTION

Many of today's electronic circuits require highly accurate voltage or current references in order to function within stringent specification requirements. These references provide either a supply independent and/or temperature independent current or voltage, which allow the entire circuit to function properly under a wide range of the external supply voltages and temperatures. Consider electronic sensors used to measure a physical quantity like pressure or acceleration. It is required that the measurement of the carrying information output will be within some predetermined error band. This implies that sensor's signal conditioning circuit must be implemented in a way that meets the required output accuracy. To accomplish this, among other things, some sort of accurate reference is needed, for example a biasing current. It is not unusual that this reference current has to be accurate to +/−30 parts per million per degree Celsius (ppm/°C.).

Also, as the technology of integrated circuits advances, minimizing the size of the IC and keeping any external parts needed to a minimum is of primary importance.

Some prior art solutions have used a precision reference voltage such as a bandgap circuit embodied on the IC and an external, low temperature coefficient (TC) resistor, to generate a precision current. When referring to a low TC resistor, it is meant that the TC of the resistor is on the order of magnitude of +/−30 ppm/°C. The integrated bandgap circuit acts as a source of a supply independent and temperature compensated voltage. While this solution accomplishes the goal of providing a precision current reference which is temperature and supply independent, the need for the external low TC resistor takes up valuable board space and significantly increases the cost and decreases the reliability of the circuit.

Other prior art solutions use a bandgap voltage reference and a special internal, integrated resistor that has the lowest possible TC. However, the lowest possible TC resistor in, for example, a typical CMOS IC process is a special buried n-type resistor with a TC of approximately 320 ppm/°C. Because the TC of this resistor is non-zero, the resultant current reference does not generate a temperature independent current reference and will have a TC of -320 ppm/°C. when sourced with a zero TC bandgap circuit voltage. Thus, this solution does not accomplish the goal of providing a precision current reference which is temperature independent even though supply independence is achieved. Therefore, it would be highly desirable to provide a temperature and supply independent current reference fully contained on the IC and without the need for any external resistors.

BRIEF DESCRIPTION OF THE DRAWINGS

FIG. 1 is a circuit diagram showing a current reference in accordance with the present invention;

FIG. 2 is a circuit diagram showing a typical bandgap voltage reference; and FIG. 3 is an alternative embodiment of a portion of the circuit diagram of FIG. 1.

DESCRIPTION OF A PREFERRED EMBODIMENT

A current reference 10 in accordance with the present invention is shown in FIG. 1. Current reference 10 includes a voltage source 12, that is independent of a supply voltage, Vdd, and is applied to first and second operatively connected resistors, R1 and R2, respectively. Current reference 10 further includes op amps A1 and A2 and transistor P1. Voltage source 12 has a positive temperature coefficient that can be expressed as $TC_{\Delta Vbe}$. In accordance with the present invention, first resistor R1 has a TC less than the TC of voltage source 12 and second resistor R2 has a TC greater than the TC of voltage source 12. A resistance value of each of first and second resistors R1 and R2 is set such that a combined TC of first and second resistors R1 and R2 is essentially equal to the TC of voltage source 12 such that current reference 10 produces a current essentially independent of a temperature and the supply voltage, Vdd.

FIG. 2 discloses a simplified typical voltage source 12 commonly referred to as a bandgap reference. Bandgap reference 12 produces a supply independent and a temperature compensated voltage. In this invention only the part of the voltage source 12 that produces ΔVbe voltage is used. By doing this there is no interference with the generation of the reference voltage. Thus, while the voltage reference is preserved, the current reference 10, independent of the voltage reference is created allowing the use of both, a voltage and a current reference on the same IC. Voltage source 12 includes transistors 20 and 22 connected as shown to an output of an op amp 24. Transistors 20 and 22 are also connected to a supply voltage Vdd. A resistor 26 is connected between transistor 22 and output terminal 14. A resistor 28 is connected between output terminals 14 and 16, as shown, as well as to the non-inverting positive input of op amp 24. A transistor 30 is connected to transistor 20 and the inverting input of op amp 24. Finally, a transistor 32 is connected to resistor 28. In operation voltage source 12 produces a voltage ΔVbe which is the difference of the base-emitter voltages (Vbe) of both pnp diode connected transistors.

Reference current is developed using the ΔVbe voltage and appropriate resistor values of R1 and R2. As was mentioned before the ΔVbe voltage is taken from a common AVbe generator that is a part of most CMOS ICs having a bandgap voltage reference. As shown in FIG. 2, the ΔVbe voltage is developed by passing the same current through the two bipolar transistors 30 and 32 that have different emitter areas. The same current is maintained by transistors 20 and 22. A typical on-chip bandgap circuit implemented in CMOS technology uses substrate pnp transistors with emitter areas having a ratio of about 24:1. The TC of the ΔVbe voltage, i.e. voltage source 12, in this circuit would be approximately +3300 ppm/°C. Since Vbe voltages of the pnp transistors are independent of the supply voltage Vdd so is the resultant voltage ΔVbe.

Assuming a zero input offset voltage of the op amps A1 and A2, the bias current achieved in the circuit of FIG. 1 can be expressed as $$I=\Delta Vbe/R \qquad \text{Equation 1}$$

where R=R1+R2 is a total resistance of a series combination of R1 and R2.

Temperature compensation of the Equation 1 current is achieved by using the ΔVbe voltage and an appropriate combination of R1 and R2 resistor values. If the TC of ΔVbe is expressed as $TC_{\Delta Vbe}$=3300 ppm/°C. then, to eliminate the temperature influence of this TC on current reference 10, the total resistance TC ($TC_R$) must be $$TC_{\Delta Vbe}=TC_R \quad \text{Equation 2}$$

which gives $$I=\frac{\Delta Vbe(25^\circ\,C)[1+TC_{\Delta Vbe}(T-25^\circ\,C)]}{R(25^\circ\,C)[1+TC_R(T-25^\circ\,C)]}=\frac{\Delta Vbe(25^\circ\,C)}{R(25^\circ\,C)} \quad \text{Equation 3}$$

In the preferred CMOS process, it is not possible to create a resistor having a TC value of 3300 ppm/°C. However, there are resistors with TCs much higher and much lower. In particular, an n-well resistor may have a TC of approximately 7400 ppm/°C. and a p-diffused resistor may have a TC of 1200 ppm/°C. Thus, if we have R1 be an n-well type resistor and R2 be a p-diffused type resistor connected, for example, in series, and set their 25° C. resistance values appropriately, an overall $TC_R$ can be obtained to provide the required TC to match the $TC_{\Delta Vbe}$ of 3300 ppm/°C. This can be summarized by the following equation:

$$TC_R=k\ TC_{R1}+(1-k)TC_{R2} \quad \text{Equation 4}$$

where $$k=R1/(R1+R2)\text{ at }25^\circ\text{ C.} \quad \text{Equation 5}$$

By setting k equal to the appropriate value, an overall $TC_R$ can be adjusted to the required 3300 ppm/°C. This can be simply calculated by solving Equation 4 where "k" is unknown. The present invention is not limited to a series connection of resistors R1 and R2. R1 and R2 may be connected in parallel and the TC of the parallel combination can be expressed with the equation of:

$$TC_R=(1-k)TC_{R1}+k\ TC_{R2} \quad \text{Equation 6}$$

where $$k=R1/(R1+R2)\text{ at }25^\circ\text{ C.} \quad \text{Equation 7}$$

Again by setting 'k' to the appropriate value, an overall $TC_R$ can be adjusted to the required 3300 ppm/°C. This can be simply calculated by solving Equation 6 where $TC_R$, $TC_{R1}$ and $TC_{R2}$ are known and 'k' is unknown.

In the circuit diagram shown in FIG. 1, op amps A1 and A2 are preferably normal CMOS op amps. Their main purpose is to mirror the differential voltage, ΔVbe, across resistors R1 and R2. Op amp A2 acts as a simple voltage follower and produces, at the node 19, a voltage that is equal to the voltage at 16. Op amp A1 is working in the current sink configuration and mirrors the voltage at 14, at node 18. Thus, the ΔVbe voltage being the difference of the voltages at 14 and 16 is buffered by being applied to the noninverting inputs of op amps A1 and A2 and this voltage appears directly across the connection of resistors R1 and R2. The resultant current, $I_b$, which is being determined by the voltage ΔVbe and a total resistance ratio, is also a drain current of transistor P1. As those skilled in the art will appreciate, the current can then be mirrored or scaled accordingly to meet the particular IC biasing requirements. The table below sets forth an example of the performance of the current reference 10 at a range of temperatures.

| Temperature °C. | Ib μA | TC ppm/°C. |
|---|---|---|
| −40 | 66.08 | −23 |
| 25 | 65.98 | 0 |
| +125 | 66.18 | 30 |

As can be seen from the table, the current, $I_b$, of current reference 10 is very precise and exhibits a very low overall TC.

From Equations 4 and 6 it can be seen that in order to achieve the required $TC_R$ for temperature compensation of the current the ratio 'k' has to be precisely set. Adjustment of the 'k' ratio can be accomplished by adjustment of R1 or R2 or both resistors values using CMOS implemented, low resistance switches.

Referring to FIG. 3, the resistor R1 or R2, can be a series of resistors having switches 34 connected across them such that the resistors 36 can be shorted out as necessary to provide for the required resistance value to yield the proper 'k' and thus, the proper TC.

I claim:

1. A current reference comprising:

first and second operably connected resistors;

a voltage source independent of a supply voltage applied to the first and second resistors, wherein the voltage source has a positive temperature coefficient; and wherein the first resistor has a temperature coefficient less than the voltage source temperature coefficient and greater than zero and the second resistor has a temperature coefficient greater than the voltage source temperature coefficient and a resistance value of each of the first and second resistors is set such that a combined temperature coefficient of the first and second resistors is essentially equal to the voltage source temperature coefficient such that the current reference produces a current essentially independent of a temperature of the current reference and the supply voltage.

2. The current reference of claim 1 wherein the first and second resistors are connected in series.

3. The current reference of claim 2 wherein the combined temperature coefficient of the first and second resistors is set according to the equation $TC_R$=k $TC_{R1}$+(1−k) $TC_{R2}$, where $TC_R$ is the combined temperature coefficient, $TC_{R1}$ is the temperature coefficient of the first resistor, $TC_{R2}$ is the temperature coefficient of the second resistor and k is a ratio of a value of the first resistor to a sum of values of the first and second resistors.

4. The current reference of claim 1 wherein the first and second resistors are connected in parallel.

5. The current reference of claim 4 wherein the combined temperature coefficient of the first and second resistors is set according to the equation $TC_R$=(1−k) $TC_{R1}$+k $TC_{R2}$, where $TC_R$ is the combined temperature coefficient, $TC_{R1}$ is the temperature coefficient of the first resistor, $TC_{R2}$ is the temperature coefficient of the second resistor and k is a ratio of a value of the first resistor to a sum of values of the first and second resistors.

6. The current reference of claim 1 wherein at least one of the first and second resistors is adjustable.

7. The current reference of claim 1 wherein the current reference is embodied in a single integrated circuit.

8. The current reference of claim 7 wherein the current reference is CMOS.

9. The current reference of claim 7 wherein the first resistor is an n-well resistor and the second resistor is a p-diffused resistor.

10. A current reference embodied in a single integrated circuit comprising:

first and second connected resistors diffused in the integrated circuit such that the first resistor is an n-well resistor and the second resistor is a p-diffused resistor;

a voltage source independent of a supply voltage applied to the first and second resistors, wherein the voltage source has a positive temperature coefficient and forms a portion of the integrated circuit; and wherein the first resistor has a temperature coefficient less than the voltage source temperature coefficient and greater than zero and the second resistor has a temperature coefficient greater than the voltage source temperature coefficient and a resistance value of each of the first and second resistors is set such that a combined temperature coefficient of the first and second resistors is set such that a combined temperature coefficient of the first and second resistors is essentially equal to the voltage source temperature coefficient such that the current reference produces a current essentially independent of a temperature of the current reference and the supply voltage.

11. The current reference of claim 10 wherein the integrated circuit is embodied in CMOS.

* * * * *